United States Patent [19]

Smith

[11] Patent Number: 4,508,776

[45] Date of Patent: Apr. 2, 1985

[54] METALLISED FABRIC

[76] Inventor: Theodore D. Smith, Heathrow, Brimpton Rd., Baughurst, Hampshire, England

[21] Appl. No.: 540,673

[22] Filed: Oct. 11, 1983

[30] Foreign Application Priority Data

Oct. 12, 1982 [GB] United Kingdom ..... 8229142

[51] Int. Cl.[3] ..... B32B 15/14; E06B 9/24

[52] U.S. Cl. ..... 428/248; 2/69.5; 5/482; 47/17; 350/1.7; 427/245; 427/250; 427/404; 427/409; 428/252; 428/263; 428/285; 428/296; 428/315.9; 428/333; 428/336; 428/341; 428/342; 428/912.2; 160/66; 160/84 R; 160/238

[58] Field of Search ..... 427/245, 250, 404, 409; 428/248, 252, 263, 285, 296, 315.9, 333, 336, 341, 342, 912.2; 350/1.7

[56] References Cited

U.S. PATENT DOCUMENTS

| | | | |
|---|---|---|---|
| 3,946,788 | 3/1976 | Van Muyen | 160/84 R |
| 4,032,681 | 6/1977 | Jonnes | 428/253 |
| 4,390,588 | 6/1983 | Ebneth et al. | 428/263 |
| 4,457,966 | 7/1984 | Pusch | 428/263 |

*Primary Examiner*—James C. Cannon

*Attorney, Agent, or Firm*—McGlew and Tuttle

[57] ABSTRACT

A microporous metallized fabric suitable for use as a thermally-insulating material in a hostile environment comprises a microporous fabric substrate for example of a spun-bonded polyethylene having a layer of aluminum deposited thereon by a vacuum deposition technique. A thin layer—typically of 0.9–1.0 g/m$^2$—of a polyamide-based ink is then printed on to the metallizing, by way of a photogravure printing process, in such a way as not to affect the porous structure of the metallized fabric.

The metallized fabric of this invention finds a particular application as screening for commercial glass-houses, to reduce the heat-losses therefrom.

10 Claims, No Drawings

METALLISED FABRIC

BACKGROUND TO THE INVENTION (a) Field of the Invention

This invention relates to metallised fabrics, and in particular is concerned with a so-called microporous metallised fabric suitable for use where thermal insulating properties are required. The invention also relates to a method of manufacturing such a fabric.

(b) Description of the Prior Art

It is known to metallise a least one surface of a fabric in order to enhance the thermal insulating properties of that fabric. For the case of a porous fabric, provided that the metallising is performed in accordance with known procedures, the metallising does not significantly affect the porous nature of the fabric, nor does the metallising significantly reduce the durability of the fabric; moreover, the metallising often increases the flexibility of the fabric. As a result, metallised fabrics of this kind have been used in the manufacture of apparel intended to be worn in extreme climatic conditions, and also in the manufacture of articles required to have excellent thermal-insulating characteristics coupled with light weight, such as blankets and sleeping bags. More recently, such metallised fabrics have been used in the manufacture of blinds for the screening of glass-houses: by drawing out a blind of such fabric over and around the crop-growing area of a glass-house when the external ambient temperature is below that within the glass-house, the heat loss from the glass-house can greatly be reduced, leading to much lower heating costs.

The substrate fabric for use in the manufacture of a metallised fabric of the kind described above may be woven from natural fibres, such as cotton fibres, or may be woven from blended natural and synthetic fibres or even just from synthetic fibres. More commonly however the substrate fabric is manufactured from continuous, relatively fine fibres of a synthetic resin (polymer) such as a polyethylene or a polyester, which fibres are spread with a random orientation into a thin layer, and then united by the application of heat and pressure; such a manufacturing method can be performed in manner known per se so that the finished fabric has a microporous structure. A synthetic microporous fabric of this kind is sold by E. I. du Pont de Nemours, Inc., under the Trade Mark TYVEK, Style 1621C or 1622E.

A substrate fabric of the kind just described above may be metallised, conventionally with aluminum, by means of a vacuum deposition technique. This metal has excellent thermal reflective properties which greatly enhance the thermal insulative characteristic of the finished metallised fabric, and also aluminum particularly lends itself to deposition in this way. Moreover, it is possible to deposit a sufficiently small amount of aluminum so as not significantly to affect the porous nature of the fabric whilst still imparting to the fabric the required heat reflective properties. The porous nature of the metallised fabric is most important for many of the uses of the fabric, where the fabric must be able to "breathe"—that is to say, moisture laden air may pass through the fabric.

As mentioned above, metallised fabrics of the just-described kind have been used for the manufacture of blinds for the thermal insulation of glass-houses. When metallised, the aluminum metallising is directed outwardly, and the blind relies on the so called 'emissivity' characteristic of the metallised fabric—that is to say, the ability of the fabric to radiate heat inwardly of the glass-house from the non-metallised surface. However, experience has shown that a glass-house blind made of this material may have a very limited life, in that the aluminum metallising relatively quickly starts detaching from the substrate fabric. Though the rate of detachment might be greatest where the fabric is subjected to the greatest mechanical stresses—for instance by friction or abrasion on fixed components, or by flexing or crumpling of the fabric—nevertheless sometimes the metallising does detach even where the mechanical stresses are quite small. The reasons for this are not fully understood but are thought to be connected with the high humidity environment which often prevails in a glass-house or possibly connected with the precise chemical composition of such liquid as may contact or collect on the top surface of the glass-house blind. A somewhat similar problem has been noted when metallised fabrics are used in the presence of moisture, for instance in the case of clothing.

In an attempt to prolong the life of a metallised fabric subjected to a hostile environment, recently various attempts have been made to enhance the adhesion of the aluminum metallising to the substrate fabric, but up to the present time these attempts have met with little or no success. Increasing the thickness of the metallising can reduce the flexibility of the fabric, leading to yet more rapid detachment of the metallising if the fabric is crushed or crumpled, and in any event an increased metallising thickness tends to block the pores of the fabric. On the other hand, a protective post-treatment such as the application of a lacquer, varnish or other siccative paint-like coating also tends to block the pores either completely or to an unacceptable extent, if that post-treatment is to have any effect.

OBJECTS OF THE INVENTION

It is a principal object of this invention to provide a metallised fabric which is able to display superior life-expectancy as compared to known metallised fabrics, especially when subjected to hostile environments.

A further object is to provide a microporous spun-bonded oelefin substrate material having a layer of aluminum deposited thereon, wherein the tenacity of the aluminum layer is greatly enhanced.

Yet another object of the invention is to provide an improved microporous synthetic metallised fabric especially suitable for use as a thermal-insulating screen in a commercial glass-house, to reduce the heat losses from the crop-growing area thereof. The fabric may also advantageously be used in the manufacture of clothing, suitable for wearing in extremes of climate.

SUMMARY OF THE INVENTION

In accordance with the foregoing objects, this invention provides a microporous metallised fabric comprising a microporous flexible fabric substrate having a layer of metal deposited on at least one side thereof, and a thin film of a polyamide-based ink printed on to the deposited metal at such a rate as not significantly to affect the microporous nature of the fabric substrate.

This invention further provides a method of manufacturing a microporous metallised fabric, including a first step of metallising at least one surface of a microporous fabric, and a second step of printing on the metallised surface a thin film of a polyamide-based ink at such a rate that the microporous structure of the metallised fabric is not significantly affected by the ink film.

It has been found that the use of polyamide-based ink as a post-treatment on the metallising of a metallised fabric most significantly prolongs the life of that metallising, and by employing a conventional printing process to apply such as ink, the ink may be deposited on the metallising in an amount per unit area which is sufficiently small not significantly to affect the microporous structure of the substrate fabric.

Further objects and advantages of this invention will be apparent from the following detailed description of the invention, and from the specific Example hereof set out below.

DESCRIPTION OF THE PREFERRED EMBODIMENTS

Polyamide-based printing inks are known per se, and comprise a suspension of a polymerisable amide resin in a solvent, the resin polymerising as the solvent evaporates after the ink has been printed on a surface. An example of such an ink is that supplied by Porth Textiles under the Ink Number PT 932.

The polyamide-based printing ink as used in this invention preferably is applied at a rate of from 0.75 to 1.25 g/m$^2$ and most preferably at a rate from about 0.9 to 1.0 g/m$^2$, so as to leave a deposited film of a polyamide ink having a thickness of the order of about one micron ($1\times10^{-6}$ m). The lower limit for the polyamide film thickness is defined by the need to protect the metallising from detachment from the fabric whereas the upper limit is defined by the requirement not to block the pores of the fabric; preliminary trials have shown that if the ink is printed on at rates significantly outside the range mentioned above, the resultant film may not be able to impart the desired properties to the metallised fabric.

The ink film printed on the metallising may be coloured as desired, but so as not substantially to affect the reflective properties of the metallising, it is preferred for the ink to be tinted only lightly, for example with a silvery or gold colour. This may however not be particularly important when the fabric is to be used as a glass-house blind, relying on the emissivity characteristic.

It is most preferred for the ink to be printed on the metallising by means of a photogravure printing process, using an appropriately etched roller so as to obtain the required deposited film thickness. Moreover, tests have shown that optimum properties are obtained if the ink is applied by such a process relatively shortly after the metallising has been completed: typically, the ink should be applied before oxidation of the metallising has advanced to a too great an extent. Thus, depending upon the particular conditions, the preliminary indications are that the sooner the ink is printed on the metallised surface, the more consistent and the better the results are likely to be. Nevertheless, the ink should be applied within 48 hours, but more preferably sooner.

The metal layer on the fabric substrate in this invention preferably comprises aluminum, deposited by a vacuum deposition technique on the fabric substrate, with a thickness lying in the range of from 200 to 300 Å i.e. 20 to 30 nm). As to the fabric substrate itself, it is preferred for this to comprise a so-called spun-bonded oelefin, such of a polythene resin. The manufacture of such a spun-bonded oelefin should be performed in such a way as to give that fabric a microporous structure.

One specific Example of the most preferred aspects of this invention, as set out above, will now be described in detail.

A 3000 yard (2743 meter) roll of Tyvek (Trade Mark) Style 1621C and sold by E. I. du Pont de Nemours, Inc. was subjected to a vacuum deposition metallising process, so as to deposit on one surface of the fabric a layer of aluminum the thickness of which fell in the range of from 20 to 30 nm. The metallising process employed is well-known and understood by those skilled in the art and was performed in accordance with accepted procedures; it forms no part of this invention and will not therefore be described in more detail here.

Within two hours of the metallising process, the metallised Tyvek was passed through a photogravure printing machine so as to print on the metallised surface of the Tyvek a film of a polyamide-based ink having a light golden tint. The actual ink employed was Ink Number PT 932, as supplied by Porth Textiles. The photogravure printing process was performed in such a way as to deposit approximately 0.9 g/m$^2$ of the ink, resulting in a dried ink film of approximately one micron thickness.

After the ink had been allowed sufficient time for the solvent to evaporate, leading to the formation of a polymerised dry film over the metallising, the metallised and printed fabric was rolled, for subsequent use in the manufacture of a thermal-insulating blind for a glass-house.

Preliminary trials on the example of fabric of this invention manufactured as described above showed that when the fabric was subjected to a high humidity environment and then also subjected to mechanical stresses including friction and crumpling, the metallising was adequately protected by the ink film, leading to a much greater life expectancy for the fabric, as compared to metallised Tyvek not subjected to the post-treatment of printing with a polyamide-based ink. Moreover, the microporous nature of the metallised and printed Tyvek was apparently not significantly affected by the presence of the polyamide-based ink film printed over the aluminum metallising carried by the Tyvek substrate.

I claim:

1. A microporous metallised fabric comprising a microporous flexible fabric substrate having a layer of metal deposited on at least one side thereof, and a thin film of a polyamide-based ink printed on to the deposited metal at such a rate as not significantly to affect the microporous nature of the fabric substrate.

2. A microporous metallised fabric according to claim 1, in which the printed film of a polyamide-based ink has a thickness of the order of about one micron ($1\times10^{-6}$ m).

3. A microporous metallised fabric according to claim 1, in which the ink is printed on the metallised layer by means of a photogravure printing process, depositing the ink at a rate of from 0.75 to 1.25 g/m$^2$ but preferably from 0.9 to 1.0 g/m$^2$.

4. A microporous metallised fabric according to claim 1, in which the ink is printed on to the metallising within 48 hours of the metallising being completed.

5. A microporous metallised fabric according to claim 1, in which the metallised layer consists of aluminum, deposited by a vacuum deposition technique on the fabric substrate, to have a thickness lying in the range of from 200 to 300 Å (20 to 30 nm).

6. A microporous metallised fabric according to claim 1, in which the fabric substrate comprises a spun-bonded oelefin of a polyethylene resin and having a microporous structure.

7. A microporous metallised fabric comprising a fabric substrate of a spun-bonded polyethylene resin and having a microporous structure, a layer of aluminum metallising deposited on one surfce of the fabric substrate with a thickness of from 200 to 300 Å, and a thin film of a polyamide-based ink printed on to the aluminum metallising by a photogravure printing process to have a film thickness of about one micron ($1\times10^{-6}$ m).

8. A method of manufacturing a microporous metallised fabric, including a first step of metallising at least one surface of a microporous fabric substrate and a second step of printing on the metallised surface a thin film of a polyamide-based ink at such a rate that the microporous structure of the metallised fabric is not significantly affected by the ink film.

9. A method according to claim 8, in which the printing step is performed by a photogravure printing process, depositing the polyamide-based ink at a rate of from 0.75 to 1.25 g/m$^2$ but preferably from 0.9 to 1.0 g/m$^2$.

10. A method according to claim 9, characterised in that the printing is performed not more than 48 hours after the metallising has been completed.

* * * * *